US005333652A

United States Patent [19]

Bassi et al.

[11] Patent Number: 5,333,652

[45] Date of Patent: Aug. 2, 1994

[54] MOBILE HOOK OF ELECTROMAGNETIC SHED-FORMING DEVICE

[75] Inventors: Dario Bassi, Chaponnay; Pierre Montibert, Peronnas, both of France

[73] Assignee: Staubli-Verdol SA, Chassieu, France

[21] Appl. No.: 64,381

[22] Filed: May 21, 1993

[30] Foreign Application Priority Data

May 25, 1992 [FR] France ..... 92 06590

[51] Int. Cl.[5] ..... D03C 3/20

[52] U.S. Cl. ..... 139/455

[58] Field of Search ..... 139/455

[56] References Cited

U.S. PATENT DOCUMENTS 4,969,490 11/1990 Seiler ..... 139/455
5,002,099 3/1991 Seiler ..... 139/455
5,095,952 3/1992 Cheng ..... 139/455

FOREIGN PATENT DOCUMENTS 288850 4/1991 Fed. Rep. of Germany ..... 139/455

*Primary Examiner*—Andrew M. Falik
*Attorney, Agent, or Firm*—Dowell & Dowell

[57] ABSTRACT

A movable hook of a shed-forming device for a weaving loom which includes a supple tongue which is urged toward engagement with the tip of a pivotable retention hook by a spring element mounted on the movable hook. The supple tongue is engageable with the retention hook to pivot an opposite end thereof into contact with an electromagnet which is selectively controlled to either retain the retention hook or release the retention hook to subsequently engage a notch in the movable hook spaced from the tongue and thereby retain the movable hook in fixed relationship to the retention hook.

3 Claims, 3 Drawing Sheets

MOBILE HOOK OF ELECTROMAGNETIC SHED-FORMING DEVICE

BACKGROUND OF THE INVENTION

1. Field of the Invention

The present invention relates to shed-forming devices n a weaving loom which includes a plurality of systems for opening and closing the shed. Each system comprises movable hooks made of plastic material which move vertically in reciprocating manner, as well as two hooks for retaining the movable hooks and an electromagnet. Each of the movable hooks is provided with a tongue cooperating with the corresponding retaining hook with a view to effecting what is called "levelling" in the art. This operation consists in pivoting the retaining hook by means of the tongue of the movable hook in order to urge the retaining hook against the pole piece of an electromagnet.

2. History of the Related Art

Applicants U.S. Pat. No. 4,739,806 discloses a device of the type in question, of which the movable hooks are made of an appropriate plastics material giving the levelling tongue the ability to flex. However, being given that this tongue is subjected to very considerable stresses of friction and deformation, even with the use of high-performance materials, there are risks of permanent deformation or of creeping of the tongue, of which the mechanical properties are thus altered. A loss of the elasticity of the tongue brings about defects in levelling which lead to defects in weaving.

The improvements forming the subject matter of the present invention aim at overcoming these drawbacks and at producing a tongue which does not lose its elasticity.

SUMMARY OF THE INVENTION

To that end, the tongue of each mobile hook of plastic material is in the free state in abutment against a metal spring blade provided with means for assembly on the corresponding hook in order that the return of each tongue towards its rest position is assisted by the reaction of the spring blade.

BRIEF DESCRIPTION OF THE DRAWINGS

The invention will be more readily understood on reading the following description with reference to the accompanying drawings, in which.

DESCRIPTION OF THE PREFERRED EMBODIMENT

Figure 1:
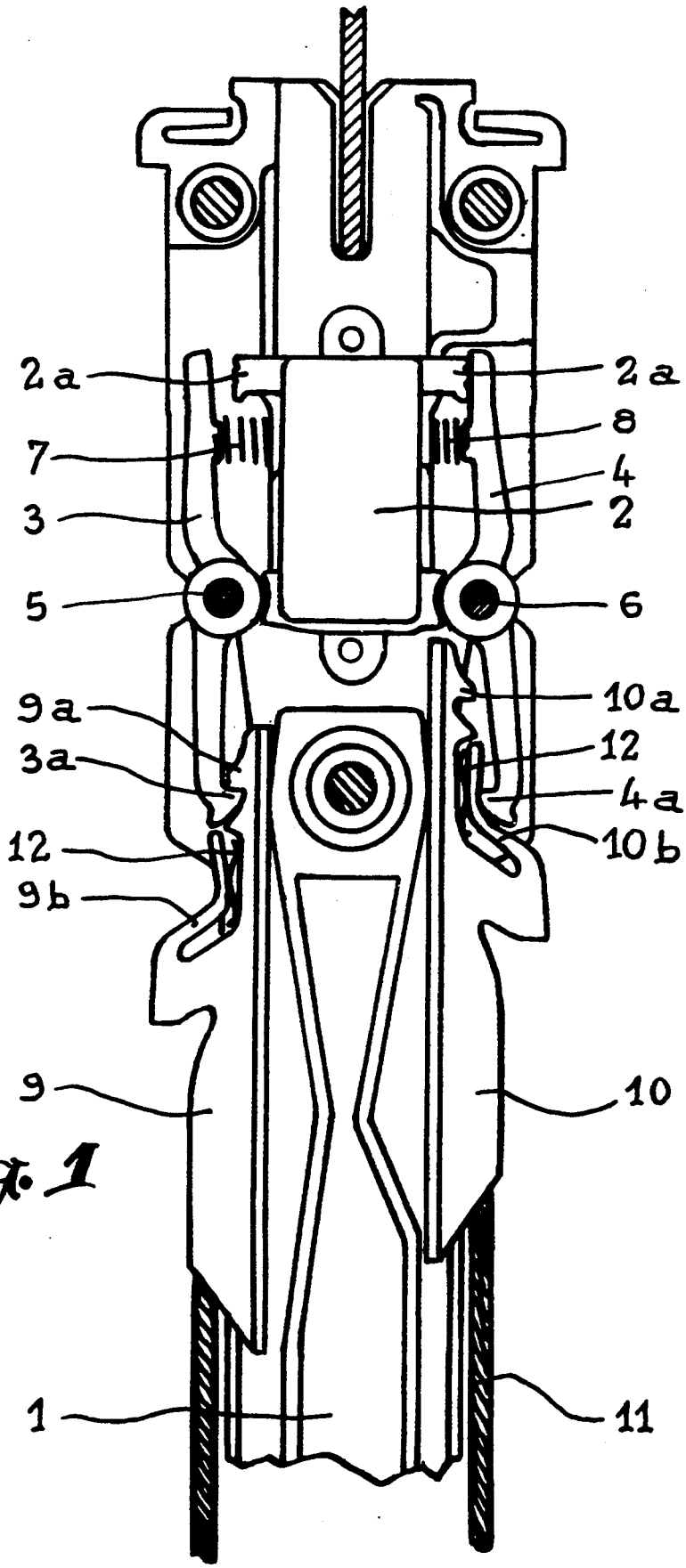
FIG. 1 is a partial longitudinal section of a shed-forming device incorporating the improvements according to the invention.

Referring now to the drawings, FIG. 1 illustrates a shed-forming device in accordance with U.S. Pat. No. 4,739,806 which has been shown on a larger scale. Due to the section, only one separating partition 1 is seen, of which the upper part supports an electro-magnet 2, while two pivoting retaining hooks 3 and 4 are mounted for free rotation about pins 5 and 6 secured to the partition 1. It is observed that these hooks 3 and 4 are pushed by springs 7, 8 so that their lower tip 3*a*, 4*a* is disposed in the rest state above the head 9*a*, 10*a* of the two movable hooks 9, 10 of the device, which are joined by a funicular element 11. This structure will not be referred to again as it is well known by the Patent mentioned above.

It is observed that each hook 9, 10 is provided with a tongue 9*b*, 10*b* of curved form and which is substantially parallel to a face 9*c*, 10*c* of the body of each hook 9, 10.

According to the invention, a spring blade 12 is disposed between the inner face (not referenced) of each tongue 9*b*, 10*b* which is located opposite the face 9*c*, 10*c* of the body of the hook. This blade 12 is generally in the form of a wide open V whose arms 12*a*, 12*b* terminate in ends curved in the direction of the top 12*c* of the blade. It is observed that the ends of the two arms, including their curved parts, are each provided with a blind slot 12*d*, 12*e*. The spring blade is, of course, made of spring steel or any other metallic material presenting the same elastic qualities.

Figure 2:
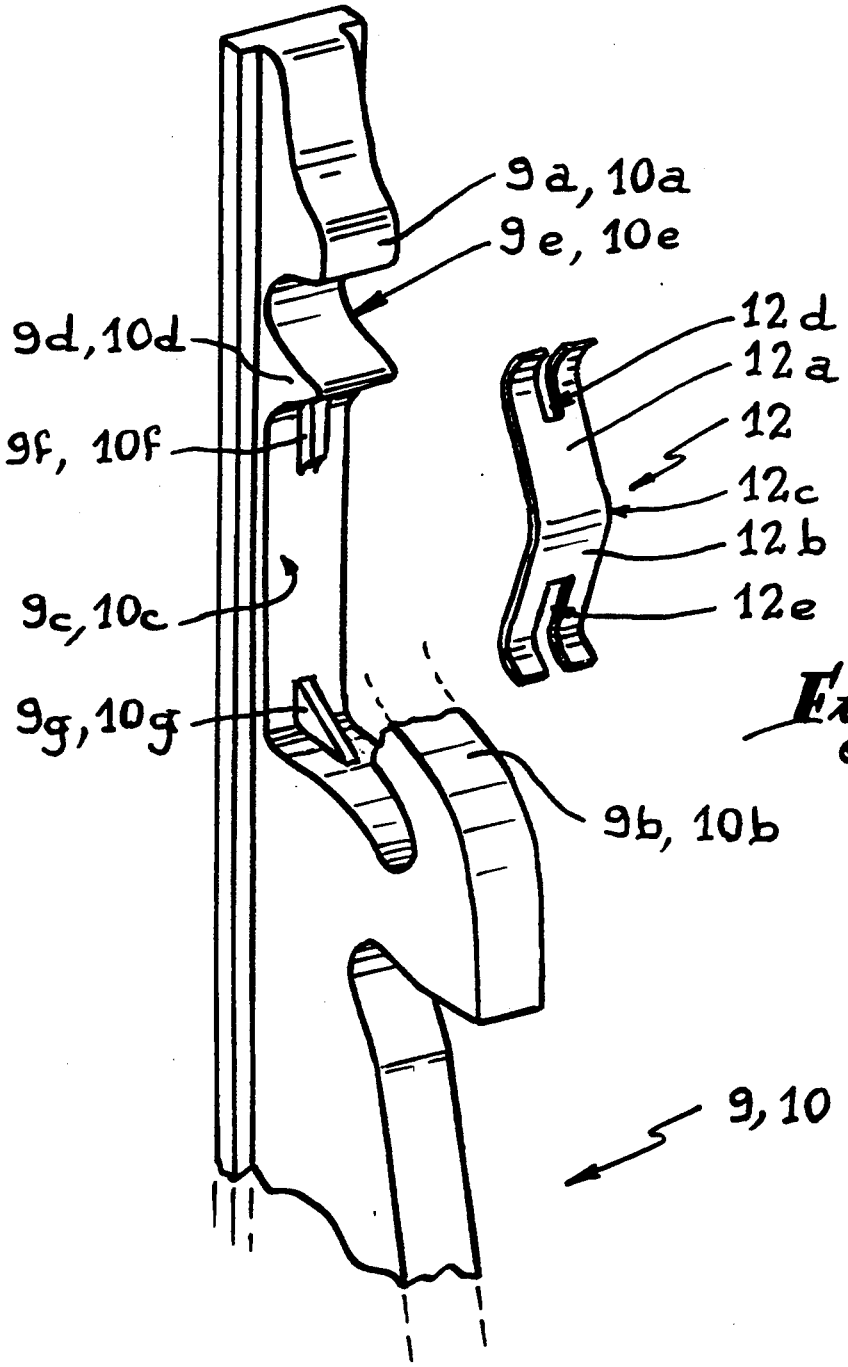
FIG. 2 shows in partial perspective, on a larger scale, a movable hook according to the invention of the device of FIG. 1. To facilitate understanding, the tongue has been truncated.

In FIG. 2, it is observed that, below the head 9*a*, 10*a* of each hook 9, 10, there is provided a heel 9*d*, 10*d* projecting from the vertical part of the face 9*c*, 10*c* and which defines a notch 9*e*, 10*e* in which is engaged the 3*a*, 4*a* of the corresponding retaining hook. At the intersection of the underneath of the projection 9*d*, 10*d* and the vertical part of the face 9*c*, 10*c* is formed a central longitudinal rib 9*f*, 10*f* of which the width is, to within the clearance, equal to that of the slots 12*d*, 12*e* of the blade 12. Similarly, at the intersection of the vertical part of the face 9*c*, 10*c* and its substantially horizontal part, a second triangular central rib 9*g*, 10*g* has been provided, of width identical to 9*f*, 10*f*.

Figure 3:
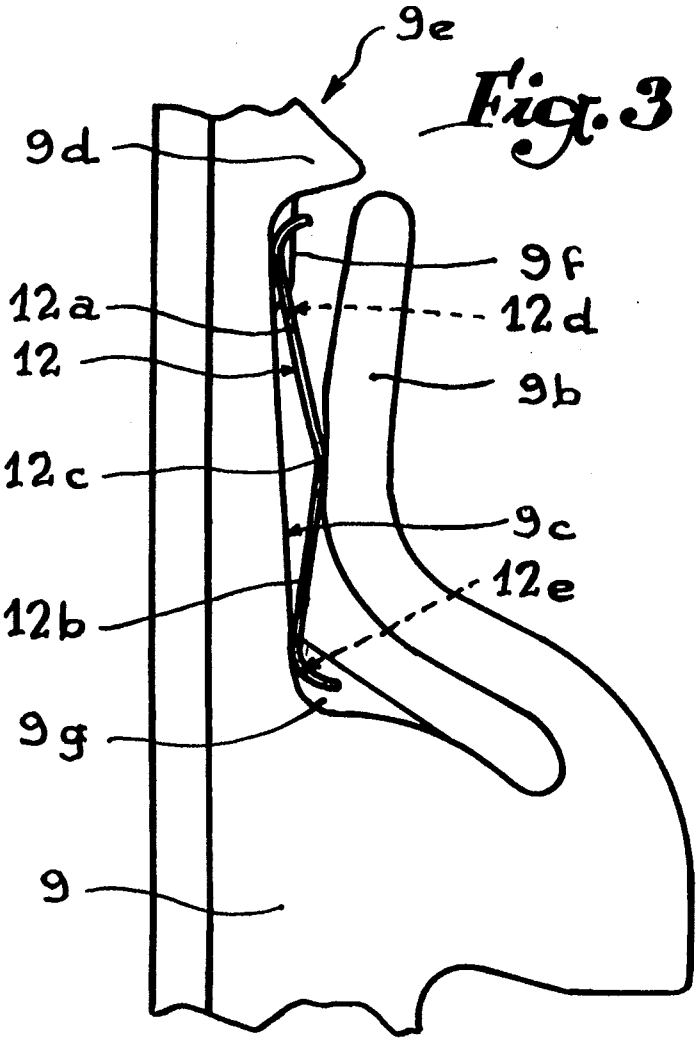
FIG. 3 illustrates on a larger scale the rest position of the tongue of a hook incorporating the improvements according to the invention.

FIG. 3 illustrates only the hook 9 with respect to which, under these conditions, the blade 12 may easily be mounted between the tongue 9*b* and the face 9*c* of its body. The same applies for hook 10. The two ribs 9*f* and 9*g* are engaged in the slots 12*d*, 12*e* of the blade. In this Fig., it is observed that the top 12*c* of the blade 12 rests against the inner face of the tongue 10*b*, i.e the one which lies opposite the face 9*c* of the body of the hook 9.

Figure 4:
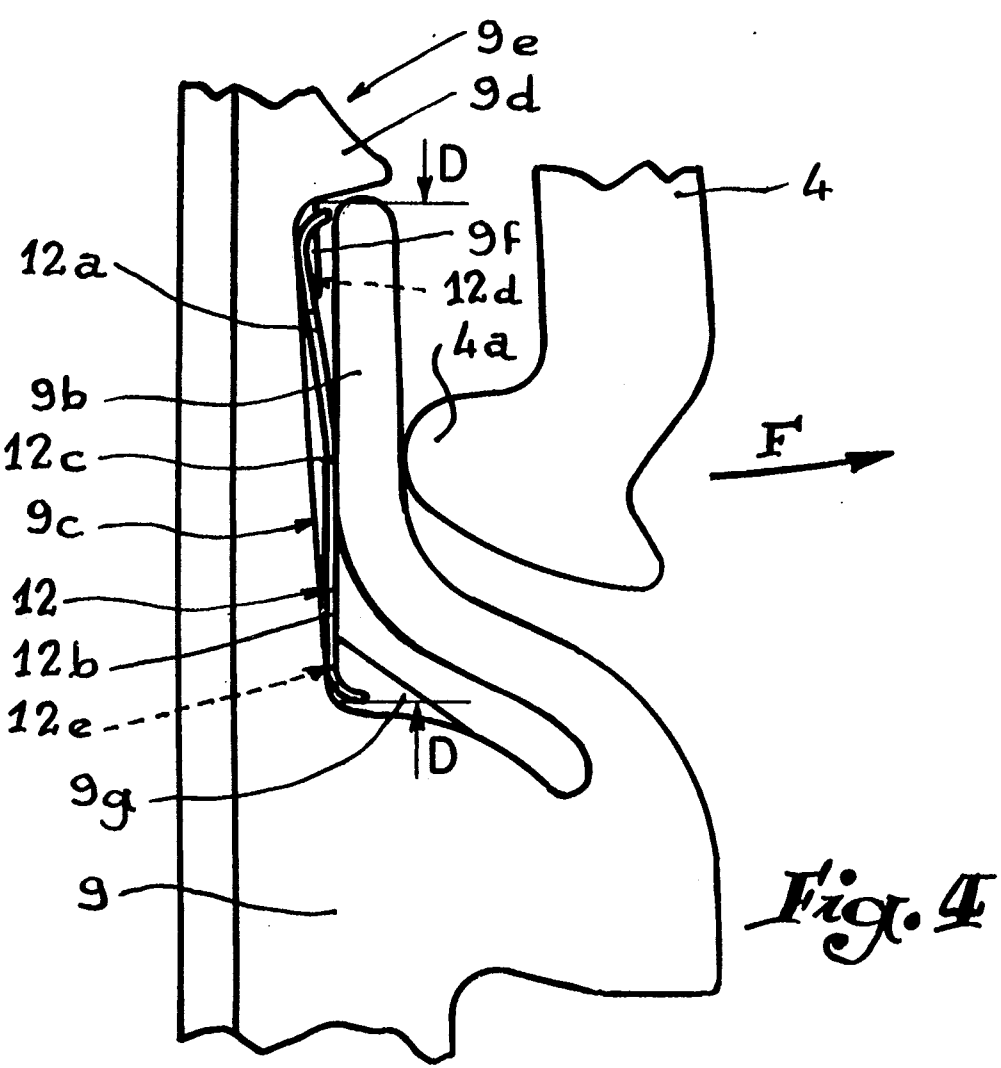
FIG. 4 is a view similar to that of FIG. 3, but showing the position of the tongue when it is compressed.

When the hook 9 rises as illustrated in FIG. 4, its head 9*a* acts on the corresponding retaining hook so as to pivot it in the direction of arrow F. At top dead center, i.e. when the hook 4 is in abutment against the pole piece 2*a* of the electro-magnet 2 (FIG. 1), the tongue 9*b* is deformed in the direction of face 9*c* of the hook 9, with the result that it compresses the spring blade 12 which thus increases in length. In its flattened position, the length of the blade, which is greater than that in the free state, is less than the distance D separating the underneath of the substantially horizontal heel 9*d* from the horizontal part of the face 9*c*. During deformation of the blade 12, its slots 12*d*, 12*e* slide with respect to ribs 9*f*, 9*g*.

If hook 9 has not been engaged by the retaining hook 4, it redescends and the spring blade 12 relaxes and returns the tongue 9*b* to the free position of FIG. 3.

A movable hook has thus been produced whose tongue conserves its elastic function because of the assistance of the spring blade 12 which has a very long life.

It must, moreover, be understood that the foregoing description has been given only by way of example and that it in no way limits the domain of the invention which would not be exceeded by replacing the details of execution described by any other equivalents.

What is claimed is:

1. In a shed-forming device in a weaving loom which includes systems wherein each systems includes two movable hooks, an electromagnet and two retaining hooks which are cooperatively engagable with the movable hooks and which are controlled by the electromagnet, the improvement comprising, each movable hook being formed of a plastic material and having a notch in which said retaining hooks are engagable, said notch defining an outwardly projecting heel, each movable hook having a face portion below said heel, a supple tongue spaced from and opposing said heel, and a spring means; and each movable hook having means for mounting said spring means to said face portion thereof so as to be in opposing relationship with respect to said supple tongue whereby said spring means urges said supple tongue outwardly from said face portion of said movable hook.

2. The shed-forming device of claim 1 in which said spring means is a metal spring blade having a central portion extending toward said supple tongue and outer end portions which engage said face portion of said movable hook, and a slot in each of said end portions of said metal spring blade.

3. The shed-forming device of claim 2 in which said means for mounting said spring means includes two spaced ribs projecting from said face portion of said movable hook, said ribs extending through said slots in said end portions of said spring blade, said ribs extending along said face portion of said movable hook so as to be engagable within said slots in said spring blade as said spring blade is urged towards said face portion.

* * * * *